US005356148A

United States Patent [19]

Elder, Jr.

[11] Patent Number: 5,356,148

[45] Date of Patent: Oct. 18, 1994

[54] SIMPLIFIED MECHANISM FOR AUTOMATICALLY TEEING PRACTICE GOLF BALLS

[76] Inventor: John F. Elder, Jr., 3301 Hunting Creek Ct., Bolling Green, Ky. 42104

[21] Appl. No.: 101,420

[22] Filed: Aug. 3, 1993

[51] Int. Cl.[5] ..... A63B 57/00

[52] U.S. Cl. ..... 273/201

[58] Field of Search ..... 273/201, 32.5, 35 R, 273/195 R

[56] References Cited

U.S. PATENT DOCUMENTS

| | | | |
|---|---|---|---|
| 1,637,537 | 8/1927 | Roberts | 273/201 |
| 2,198,968 | 4/1940 | Jewett | 273/201 |
| 3,378,263 | 4/1968 | Turnau et al. . | |
| 3,448,985 | 6/1969 | Scott | 273/201 |
| 3,549,152 | 12/1970 | Gentiluomo . | |
| 4,355,811 | 10/1982 | Williams, Sr. | 273/201 |
| 4,659,081 | 4/1987 | Cook . | |
| 4,676,397 | 6/1987 | Hoffmeister . | |
| 4,832,345 | 5/1989 | Monasco | 273/201 |
| 5,016,886 | 5/1991 | Gould | 273/201 |
| 5,131,661 | 7/1992 | Jorgensen . | |
| 5,133,557 | 7/1992 | Sugitomo . | |
| 5,145,176 | 9/1992 | Lipson . | |

*Primary Examiner*—Vincent Millin
*Assistant Examiner*—Raleigh W. Chiu
*Attorney, Agent, or Firm*—I. C. Waddey, Jr.

[57] ABSTRACT

My device includes a hopper into which a bucket of balls can be poured, a trough which receives the balls from the hopper and aligns them in single file for feeding to the teeing device; the trough is connected to a silo into which the balls are fed, one at a time to rest on a tee. A pneumatic device raises the tee to a position slightly higher than ground level so that the ball may be struck by the golfer on his practice swing. The golfer then taps a switch which causes the teeing mechanism to retract and receive another ball from the trough. The device then automatically releases to force the ball up the silo and into the teed position.

6 Claims, 3 Drawing Sheets

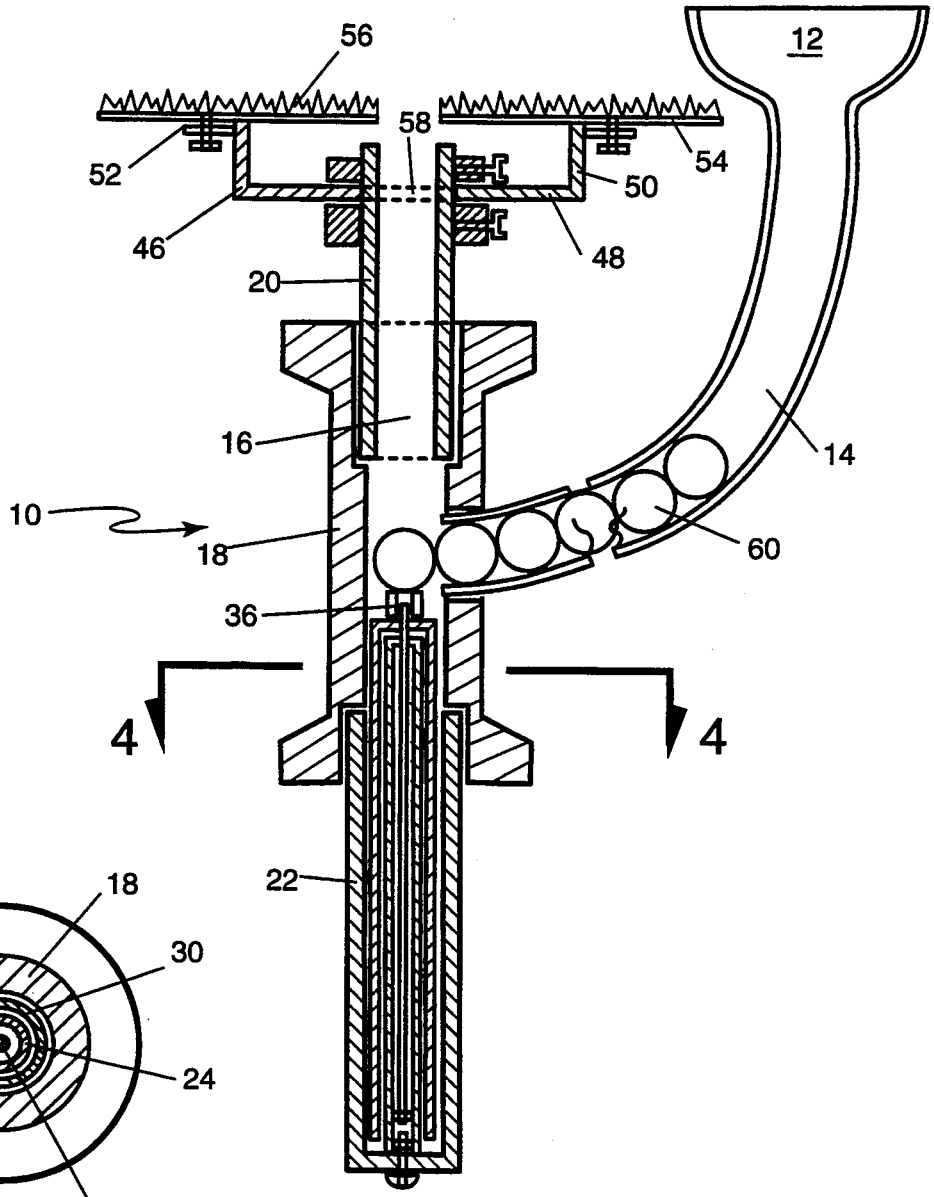
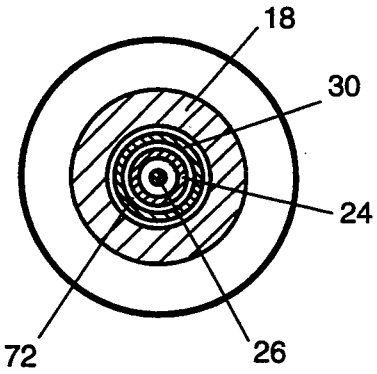
FIG. 4
FIG. 3

SIMPLIFIED MECHANISM FOR AUTOMATICALLY TEEING PRACTICE GOLF BALLS

BACKGROUND OF THE INVENTION

The present invention relates generally to a device for automatically teeing practice golf balls so that the golfer does not have to bend over and tee the ball after each practice shot. The invention relates more particularly to a simplified system for automatically teeing golf balls which has a limited number of moving parts which interconnect to make a smooth flow of balls fed from a hopper to a teeing device and a structure that provides means for adjusting the height of the ball as it rests on a tee. It will be appreciated by those skilled in the art that in the course of attempting to improve ones skills as a golfer it is generally necessary to spend hours upon hours of time at the driving range hitting practice balls. Continued and repeated practice will, hopefully, enable the golfer to improve his swing pattern and thereby improve his ability to score during an actual round of golf. The time spent at the practice range should be maximized with energy and concentration being directed to the development of the golfer's swing and analyzing the changes and results as a consequence of altering the swing path, body movement, grip, or the like. The analysis of the swing pattern may be more difficult if the golfer is required to re-tee a ball after each swing because he has to change his stance, alter the manner in which he addresses the ball or the like.

Thus, it would be highly desirable to strike a practice ball with a particular swing, have another ball automatically teed promptly after the first shot, and then strike a second ball with a slightly altered swing, stance, grip, or the like to see the comparative results. By being able to immediately compare the results of the two swings, the golfer can analyze his swing and take corrective action which should assist him in improving his overall ability as a golfer.

Historically, when taking golfing lessons, a golf pro will tee a ball for a golfer to strike and then after analyzing the golfers swing, the professional teacher will tee another ball for the golfer to strike with the swing altered to incorporate the instructions of the professional teacher. Obviously, not everyone can afford to have a professional teacher with them as they practice their golf swing, but the benefits of having the ball automatically teed for the practicing golfer should be available to all enthusiasts.

There have been attempts to provide structures that would automatically tee a practice golf ball in order to address this need. However, the prior art directed at this problem has proven to be less than adequate because such devices have been overly complicated and required a significant number of parts; often requiring electricity and gearing that can become misaligned or otherwise fall into bad repair. Such prior art devices have generally not been commercially successful because they are too expensive, too complicated and too unreliable.

What is needed then is a device for automatically teeing a golf ball at a practice range which is simple to manufacture and install, has few moving parts, is reliable and permits the golfer to use the system without having to alter his stance in order to activate the device.

Such a device is presently lacking in the market place and in the existing art.

SUMMARY OF THE INVENTION

My invention is a device for automatically teeing golf balls at a practice facility. The device is simple, has few moving parts and is reliable. The device provides for automatic adjustment of the height of a teed golf ball and a prompt feeding of the golf balls one at a time in a perfectly teed position for the benefit of the practicing golfer.

My device includes a hopper into which a bucket of balls can be poured, a trough which receives the balls from the hopper and aligns them in single file for feeding to the teeing device; the trough is connected to a silo into which the balls are fed, one at a time to rest on a tee. A pneumatic device raises the tee to a position slightly higher than ground level so that the ball may be struck by the golfer on his practice swing. The golfer then taps a switch which causes the teeing mechanism to retract and receive another ball from the trough. The device then automatically releases to force the ball up the silo and into the teed position.

BRIEF DESCRIPTION OF THE DRAWINGS

FIG. 3 is a cross sectional view of the device of the present invention.

FIG. 4 is a view of the present invention taken along the line 4—4 in FIG. 3.

DESCRIPTION OF THE PREFERRED EMBODIMENT

Figures 1, 2:
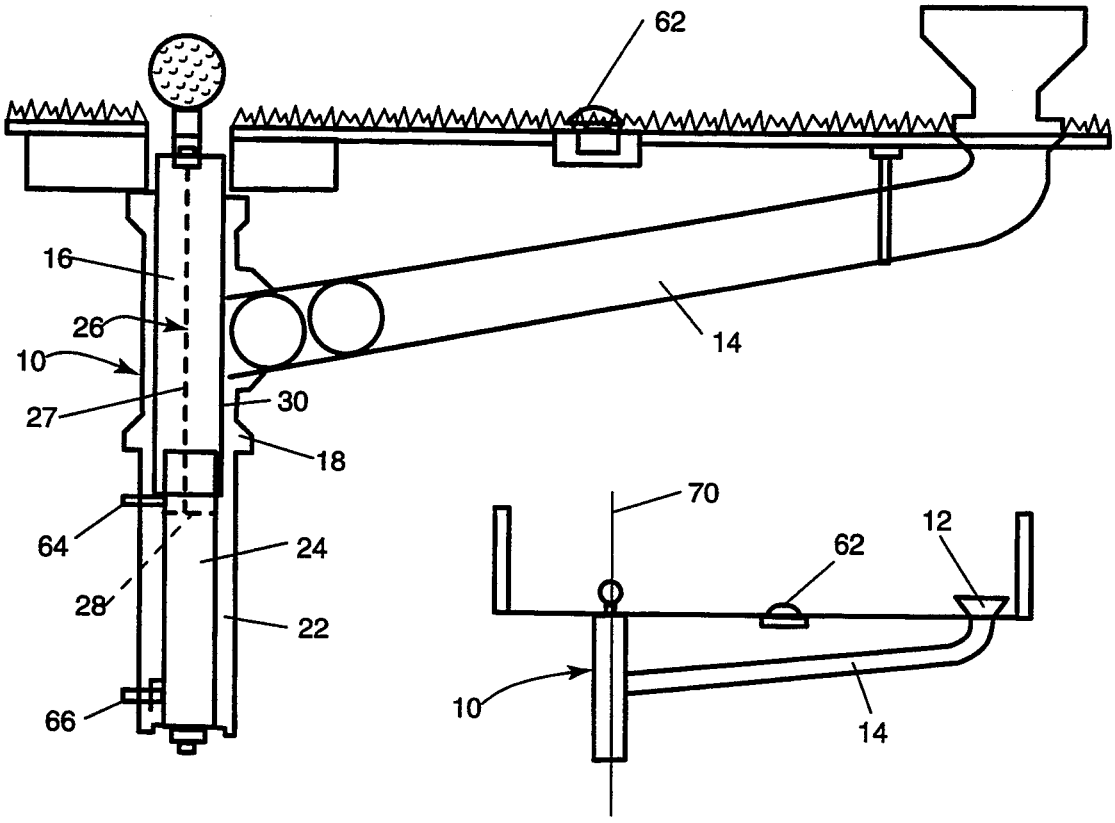
FIG. 1 is a schematic view of the automatic teeing device of the present invention.
FIG. 2 is a slightly more detailed schematic view of the present invention.

Referring to FIG. 1, a schematic illustration of the layout of the device of the present invention is shown. FIG. 1 is a cross sectional view of a typical practice station at a golf driving range. The station is divided from adjacent stations by a vertical barrier at each end and typically, there will be a number of stations aligned in end to end fashion.

In this particular station, which would be typical of each station which employs the device of the present invention, a hopper 12 is shown slightly above ground level (ground level being represented by reference numeral 56 which is normally a synthetic grass adhered to a board which lies horizontally over the practice station).

The hopper 12 is connected to a trough 14 which is in turn connected to the automatic golf ball teeing device 10. The automatic golf ball teeing device 10 is a cylindrical structure, in the preferred embodiment, as can be seen in FIG. 4 and has an axis 70 which is aligned substantially vertically.

When a bucket of golf balls are dumped into the hopper 12, they travel into the trough 14 through the force of gravity, the trough 14 being angled slightly to the horizontal with the end connected to the hopper 12 being higher than the end connected to the automatic golf ball teeing device 10. The trough 14 is preferably cylindrical and has an inside diameter slightly larger than a standard golf ball. Thus, the golf balls, by the force of gravity, feed into the trough 14 in single file and stack in the trough waiting to be teed by the automatic teeing device of the present invention.

As can be seen from FIG. 2, another schematic illustration of the invention in somewhat more detail, the device of the present invention can be manufactured essentially from standard plumbing parts. For example, the trough 14 can be a piece of standard PVC 2" diameter pipe, the silo 16 can be made from a standard PVC 2" diameter plumbers tee and the top and bottom sections of the silo 16 can include 2" standard PVC pipe glued into the counter board recesses of each end of the PVC 2" diameter plumbers tee. A switch 62 is placed in the practice station at a convenient location so that it may be tapped with the foot or the base of the golf club and when activated, the switch will activate a timed pneumatic charge which causes air pressure to lower the automatic teeing device to receive a golf bail from trough 14. The timing mechanism is set to cause the air pressure to lower the automatic teeing device only briefly so that a golf ball by the force of gravity will roll from the trough onto the tee. The timing mechanism will then relieve the air pressure which will cause the reversal of the process; air pressure being forced on the opposite end of the automatic teeing device to raise the golf bail and hold into position until such time that the switch 62 is pressed again.

Figure 5:
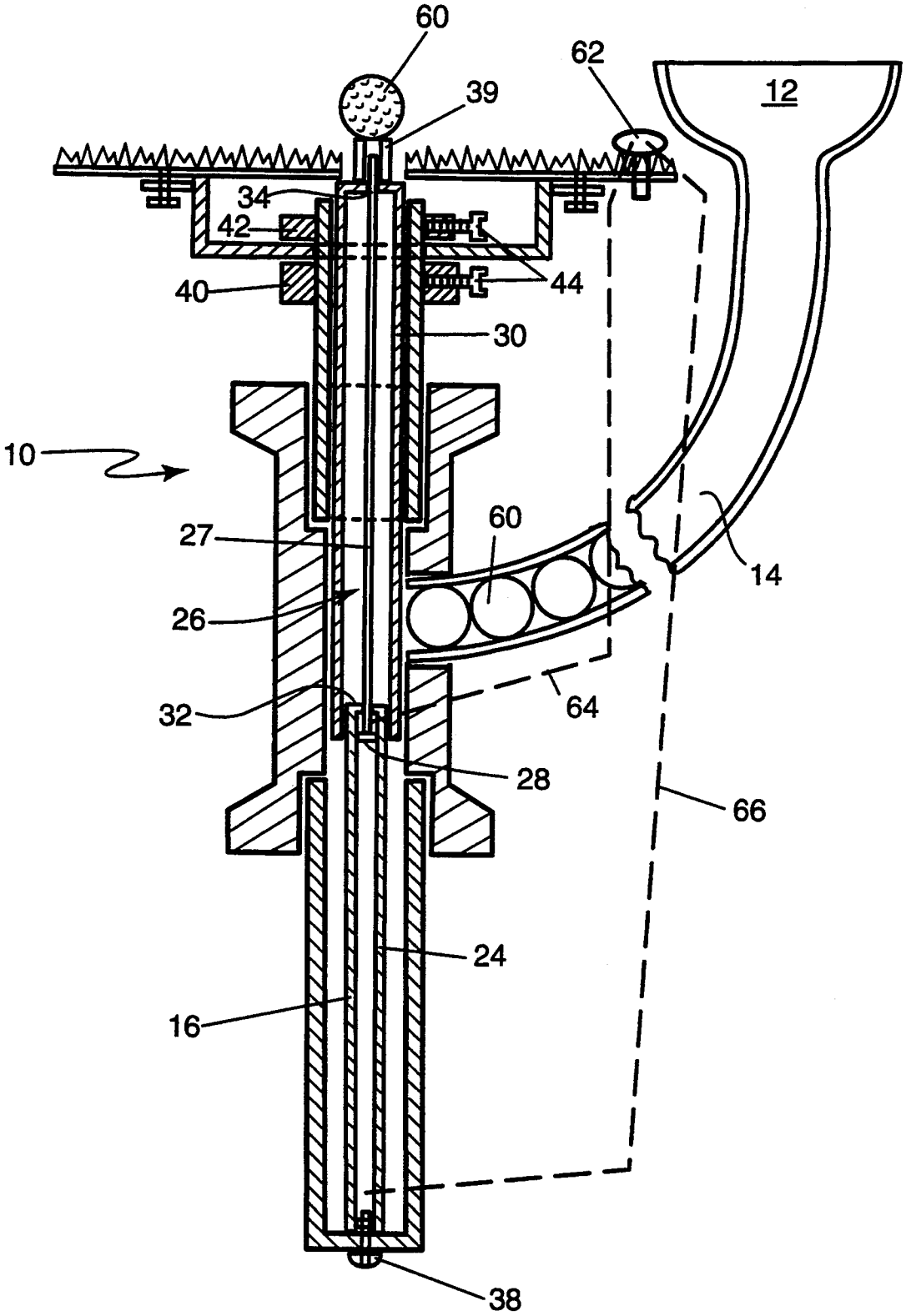
FIG. 5 is a cross sectional view of the device of the present invention with the golf ball extended to the teed position.

Referring now to FIGS. 3, 4 and 5, a more detailed illustration of the present invention is provided. FIG. 3 shows the hopper 12 feeding into the trough 14 with golf balls 60 stacked in the trough 14. The automatic teeing device 10 has silo 16 which is vertically aligned and beneath ground level as represented by synthetic grass 56. The silo 16 consists of a plumbers tee 18 which has fitted in the counterbored ends thereof an upper pipe 20 and a lower pipe 22. Of course, the silo 16 could be integrally constructed, the significant aspect of the silo being a continuous pipe-like structure having a constant inside diameter with an opening in the side thereof through which the golf bail 60 can pass from trough 14.

Mounted within the lower pipe 22 is a cylinder 24 (see FIG. 5), which may be best illustrated in schematic form in FIG. 2. The cylinder 24 is axially aligned with the silo 16 and has mounted within it piston 26 which includes piston rod 27 and piston head 28. The piston head, cylinder combination 26, 24 is a pneumatic device which is essentially air tight so that when air pressure is increased on the top side of piston head 28, the piston head will be forced downwardly thereby withdrawing the piston rod into the silo and when air pressure is increased on the bottom side of the piston head 28, the piston head is raised thereby extending the piston rod 27 upwardly through the silo.

A sleeve 30 fits over the cylinder 24 and is of a mating cross section to the cross section of the cylinder 24. In this particular case, the cross section of the silo 16, cylinder 24 and the sleeve 30 are all circular; however, it will be appreciated by those of ordinary skill in the art that varying cross section and shapes could be employing without varying the spirit of the invention. As can be seen from FIG. 5, the cylinder 24 has a cylinder cap 32 at its top which seals the cylinder. A hole centered in the cylinder cap 32 allows the piston rod 27 to extend out of the cylinder 24. At the end of the cylinder rod 27 opposite the cylinder head 28, the cylinder rod is connected to the sleeve 30 at connection 34. Thus, as the cylinder rod 27 is raised and lowered, the sleeve 30 is raised and lowered in telescopic relationship with the cylinder 24. The sleeve 30 has a vertical slit 72 (FIG. 4) through which pass the air lines 64, 66 which feed the air pressure to the cylinder 30 to cause the piston 26 to raise and lower during the course of operation of the device.

The cylinder rod 27 extends through the sleeve 30 and protrudes above the top of the sleeve 30 creating tip 36. Tip 36 may be threaded and tee 39 can be internally threaded to connect to tip 36. The tee 39 is normally a flexible (rubber or a synthetic rubber) practice tee which is cylindrical in shape and has an open top onto which the golf ball 60 will sit prior to being struck by the club of the practicing golfer as he/she practices his/her golf swing.

To facilitate the manufacture of the present invention, the cylinder 30 can be manufactured from a standard 1½" PVC pipe which will fit within the silo 16 of the device; the silo 16 has an inside diameter of 2" and mates perfectly with the 1½" diameter PVC pipe. The cylinder 30 has an internal diameter which telescopically fits over and mates with the outside diameter of the cylinder 24. The cylinder 24 is mounted by bolt 38 to the bottom of the lower pipe 22 which may be capped at its bottom most portion in any convenient fashion with the bolt 38 fixedly connected to such a cap.

The device of the present invention can be conveniently raised or lowered in order to raise or lower the extent to which a golf ball is teed above the practice surface for the practicing golfer by virtue of the structure which will now be described. Encircling the upper pipe 20 is a collar 40 which slidably engages about the upper pipe 20. The collar 40 has a set screw 44 therein which allows the position of the collar to be adjusted axially along the upper pipe 22. The collar 40 will fit flush against the bottom of the cup 46 which is a saucer-like structure that can be of circular, square or other convenient cross section. The cup 46 rests on the collar 40 and is held in position with respect thereto by the cap 42 which is similar to collar 40 in that it fits about the upper pipe 20 and is fixed in relationship to the upper pipe 20 by set screw 44. Thus, the set screws 44 may be loosened and the device of the present invention can be raised or lowered in relationship to the cup 46 which will in turn raise or lower the ultimate relationship of the golf ball 60 to the practice surface formed by board 54 and synthetic grass 56 when the piston rod is extended upwardly to its maximum height.

Cup 46 has a bottom 48 through which the adjustable automatic teeing device of the present invention extends in telescoping fashion. The cup 46 also has side walls 50 which extend upwardly and which have horizontally extending ears through which bolts pass to fix the boards 54 to the cup 46.

The device of the present invention can be conveniently mounted in any practice station of a golf ball driving range by simply trenching a modest trough along the line of practice stations to allow the insertion of the trough 24 and then digging with post hole digger or other similar device a hole into which the automatic golf bail teeing device 10 will be lowered. The boards 54 are then placed over the structure and attached to the ears 52 to securely hold the device of the present invention in place in relationship to the practice station.

The operation of the device of the present invention will now be described in detail.

Initially, the golfer will deposit a bucket of balls in hopper 12 and the balls will feed into the trough 14 in stacked alignment. When the automatic golf ball teeing device of this invention is "at rest", the cylinder 30 is in the position shown in FIG. 5. The cylinder 30 is held in that position as a result of air pressure from any convenient compressed air source passing through line 66 and into cylinder 44. At the same time, the air line 64 may be bled in order to release pressure above the piston head 28 while increased pressure is exerted on the bottom of piston head 28 as a result of the air pressure directed into the cylinder 24 through line 66. The pressure of air passing through line 66 which is exerted on the underside of the piston head 28 will cause the piston 26 to extend upwardly so that piston rod is raised to its upper most position. Because of the attachment 34 between the piston rod 27 and the sleeve 30, the sleeve 30 telescopes upwardly about the cylinder 24 and is held in alignment within the silo 16 by virtue of its telescoping fit within the channel of silo 16. The movement of the sleeve and piston rod vertically upwardly as a result of the pressure being exerted on the underside of the piston head 28 is a smooth controlled passage because of the constant cross section of the channel of the silo 16 mating with the exterior cross section of the sleeve 30 as well as the mating relationship between the inside diameter of the sleeve 30 and the outside diameter of the cylinder 24.

If a ball is placed on tee 39, the golfer can take a practice swing and strike the ball as he makes a practice shot. Next, the golfer can depress switch 62 with either his foot or with the bottom of his golf club. In its most rudimentary structure, the golfer could hold the switch 62 down and while the switch 62 is depressed, the flow of air pressure is reversed so that the increased air pressure passes through line 64 and line 66 is bled to relieve the air pressure below the piston head 28. The increased air pressure above piston head 28 and the decreased air pressure below piston head 28 will cause the piston head to be forced downwardly thereby retracting the piston rod 27 within the cylinder 24. As piston rod 27 retracts within cylinder 24, the sleeve 30, because of its attachment at 34 to the piston rod 27, will telescope downwardly over the cylinder 24 until the piston head 28 reaches the bottom of the cylinder 24. The trough 14 then opens into the silo 16 and, by the force of gravity, a golf ball 60 will roll into the silo 16 and onto the tee 39, as is shown in FIG. 3. The switch 62 can then be released and the system will be returned to its "at rest" position as shown in FIG. 5 by the force of the air pressure through line 66 on the bottom of piston head 28.

As the system returns to its "at rest" position, the raising of the sleeve 30 will intercept the golf ball 60 which is next ready to be fed into the system and the wall of the sleeve 30 will hold the golf balls in the trough as is illustrated in FIG. 5 until the golfer strikes the golf ball 60 that is located on the tee 39 in the course of his practice swing, and then reverses the process by tapping switch 62 again.

The alignment of the sleeve 30 is also controlled by virtue of the air lines 64 and 66 passing through slot 72 in the cylinder. The slot 72 fits over the air lines 64 and 66 and the engagement of the air lines with the slot 72 causes the sleeve 30 to be held against any rotation as it moves up and down in the silo.

The more sophisticated diversion of the switching mechanism 62 is such that once the switch 62 is tapped, the switch activates a timer which causes the reversal of the flow of air pressure through lines 64 and 66. The timer will be set so that the reversal of air pressure will be long enough to retract the piston head 28 to the bottom of the cylinder 24 and allow the golf ball next in position in the trough 14 to roll onto tee 39. The timer then releases and causes a reversal of the flow of air pressure through lines 64 and 66 to increase the pressure on the bottom side of the piston head 28 and lift the sleeve 30 to its "at rest" position as shown in FIG. 5. The switch, timer and air pressure valves are of standard, off-the-shelf construction. I have found that switch model no. 16001-111-037 manufactured by MAC Control, timer model no. FQP-2K manufactured by Bimba and air control valve model no. 908DX manufactured by Bimba all work suitably in the performance of the functions as described herein in connection with the automatic switching mechanism of the present invention.

As can be seen from the foregoing description, the device of the present invention is one that is simple to manufacture, has relatively few moving parts, has a limited number of parts, is easy to manufacture and simple to install and operate. The device is a substantial improvement over the devices known in the prior art and offers an opportunity for commercial exploitation which the other devices that have been developed and attempt to address this problem have failed to achieve.

Thus, although there have been described particular embodiments of the present invention of a new and useful Mechanism for Automatically Teeing Practice Golf Balls, it is not intended that such references be construed as limitations upon the scope of this invention except as set forth in the following claims. Further, although there have been described certain dimensions used in the preferred embodiments, it is not intended that such dimensions be construed as limitations upon the scope of this invention except as set forth in the following claims.

What I claim is:

1. An automatic golf ball teeing device for automatically teeing golf balls above a practice surface, said device comprising:

a. a silo adapted to be mounted beneath the practice surface, said silo having a wall and a channel of a substantially constant cross section passing through the silo, said channel having an axis;

b. said axis being substantially vertically aligned;

c. a trough into which multiple golf balls can be fed, said trough having a cross section substantially complementary to the cross sectional shape of a golf ball so as to hold the golf balls in stacked alignment;

d. a hole in the wall of the silo;

e. said trough mating with said hole so that golf balls stacked within the trough may feed into the silo;

f. a pneumatic cylinder positioned within the silo below the hole;

g. a piston within the cylinder having a piston head adapted to move within the cylinder to a lower most ball loading position and an upward most teeing position;

h. said piston including a piston rod passing through the cylinder;

i. said piston rod attached at one end to said piston head;

j. a cylindrical sleeve telescoping inside the silo and telescoping over the cylinder;

k. said sleeve attached near its uppermost end to the other end of said piston rod;

l. a tee attached to the uppermost end of the sleeve;

m. air pressure lines feeding into the cylinder on either side of the piston head; and n. switching mechanism for controlling the flow of air pressure through the air pressure lines so that greater air pressure is exerted on the underside of the piston head when the device is at rest; and when the switching mechanism is activated, greater pressure is applied to the upper side of the piston head to lower the piston in the cylinder so that the device will retract to its loading position, said pressure being reversed when the switching, mechanism is released to return the device to its at rest position.

2. The automatic golf ball teeing device as described in claim 1 wherein the sleeve also functions as a barrier to prohibit golf balls from passing from the trough into the silo when the device is in its at rest condition and said sleeve is retracted to allow a golf ball to pass into the silo when the switch is activated.

3. The automatic golf ball teeing device as described in claim 1 including a timer and the switching mechanism is connected to the timer so that when the switching mechanism is activated, the timer controls the reversal of air pressure so as to cause the device to retract to the loading position for a sufficient time to allow a golf ball to be teed onto the tee and thereafter the timer disengages and the reversal of air pressure causes the device to return to its at rest position.

4. The automatic golf ball teeing device as described in claim 1 further comprising a cup through which the silo passes, a collar concentrically mounted on the upper portion of the silo and means providing for the adjustment of the height of the silo in relationship to the cup and for fixing the location of the silo with respect to the cup to thereby permit adjustment of the height of the golf ball in relationship to the practice surface.

5. The automatic golf ball teeing device as described in claim 1 wherein the sleeve has a slot therein to allow the air lines passing through the cylinder to serve as a guiding mechanism within the said slit.

6. The automatic golf ball teeing device as described in claim 1 wherein the silo is constructed from a plumber's tee and PVC pipe connected to each end thereof.

* * * * *